US005509614A

United States Patent [19]

Nishikawa et al.

[11] Patent Number: 5,509,614

[45] Date of Patent: Apr. 23, 1996

[54] BOBBIN SUPPLYING SYSTEM

[75] Inventors: Kazuo Nishikawa, Kyoto; Takashi Nakagawa, Uji, both of Japan

[73] Assignee: Murata Kikai Kabushiki Kaisha, Kyoto, Japan

[21] Appl. No.: 431,825

[22] Filed: May 1, 1995

Related U.S. Application Data

[63] Continuation of Ser. No. 62,955, May 14, 1993, abandoned.

[30] Foreign Application Priority Data

May 22, 1992 [JP] Japan ..... 4-130633
Jul. 28, 1992 [JP] Japan ..... 4-201511

[51] Int. Cl.[6] ..... B65H 54/02; D01H 9/10

[52] U.S. Cl. ..... 242/35.5 A; 57/90; 57/281

[58] Field of Search ..... 242/35.5 A; 57/281, 57/90

[56] References Cited

U.S. PATENT DOCUMENTS 4,545,551 10/1985 Uchida et al. ..... 242/35.5 A
4,718,560 1/1988 Kiriake ..... 242/35.5 A X
4,720,967 1/1988 Guttler ..... 57/281
4,841,719 6/1989 Sasaki et al. ..... 57/281
5,010,725 4/1991 Yasui et al. ..... 57/281
5,240,193 8/1993 Backhaus ..... 242/35.5 A

FOREIGN PATENT DOCUMENTS 52475 3/1985 Japan ..... 242/35.5 A
220685 9/1989 Japan ..... 242/35.5 A

*Primary Examiner*—William Stryjewski
*Attorney, Agent, or Firm*—Loeb & Loeb

[57] ABSTRACT

A system in which a plurality of spinning frames and a plurality of winders are connected by a common bobbin conveying passage, a circulating passage having a bobbin sensor is provided on a spinning bobbin supplying passage from the bobbin conveying passage to the winders, and a stopper is provided at an inlet of the circulating passage, the stopper being adapted to stop receiving bobbins when the number of passing bobbins per a predetermined time detected by the bobbin sensor exceeds a set value.

4 Claims, 6 Drawing Sheets

BOBBIN SUPPLYING SYSTEM

This is a continuation of application Ser. No. 08/062,955, filed May 11, 1993, now abandoned.

BACKGROUND OF THE INVENTION

1. Field of the Invention

The present invention relates to a bobbin supplying system in which a plurality of winders and a plurality of spinning frames are connected by a common bobbin conveying passage.

2. Prior Art

A bobbin about which yarns spun out of spinning frames are wound is rewound on a package having a size and a shape suitable for post-steps. An automatic winder used in the aforesaid winding step has a large number of spindles of winding units juxtaposed thereon, wherein in each winding unit, a yarn is released at a high speed from the bobbin and wound on the package which is rotated by a drive drum while removing a defective yarn portion.

When one bobbin becomes empty, next bobbin is supplied and piecing takes place, and winding is again carried out. In this manner, a plurality of bobbins are supplied to obtain a full package. When 50 to 60 spinning units of spinning frames are used for one winding unit of the winders, these winders and spinning frames operate efficiently as a whole.

This leads to a practical use of a high efficient system in which a plurality of spinning frames and a plurality of winders are connected by a bobbin conveying passage. As the system of this kind, there has been employed a bobbin supplying system which has a spinning bobbin supplying passage for supplying bobbins from the bobbin conveying passage to the winders, said spinning bobbin supplying passage being provided with a circulating passage for circulating and storing the bobbins.

However, in the above-described conventional bobbin supplying system, since all bobbins are taken into the circulating passage from the bobbin conveying passage, bobbins more than as needed are sometimes taken into the circulating passage, by which jamming occurs.

SUMMARY OF THE INVENTION

It is an object of the present invention to provide a bobbin supplying system capable of preventing surplus reception of bobbins onto the circulating passage.

For achieving the aforesaid object, the present invention provides a system characterized in that a plurality of spinning frames and a plurality of winders are connected by a common bobbin conveying passage, a circulating passage having a bobbin sensor is provided on a spinning bobbin supplying passage from said bobbin conveying passage to the winders, and a stopper is provided at an inlet of said circulating passage, said stopper being adapted to stop taking in bobbins when the number of passing bobbins per predetermined time detected by said bobbin sensor exceeds a set value.

When the number of passing bobbins per predetermined time detected by the bobbin sensor exceeds a set value, the stopper provided at an inlet of the circulating passage is actuated to prevent the reception of the bobbin. Accordingly, even if the bobbins remain on the spinning bobbin supplying passage which connects the bobbin conveying passage with the circulating passage, the remaining bobbins are not taken into the circulating passage to completely prevent the surplus reception of bobbins into the circulating passage.

DETAILED DESCRIPTION OF PREFERRED EMBODIMENT

One embodiment of the present invention will be described with reference to the accompanying drawings.

Figure 1:
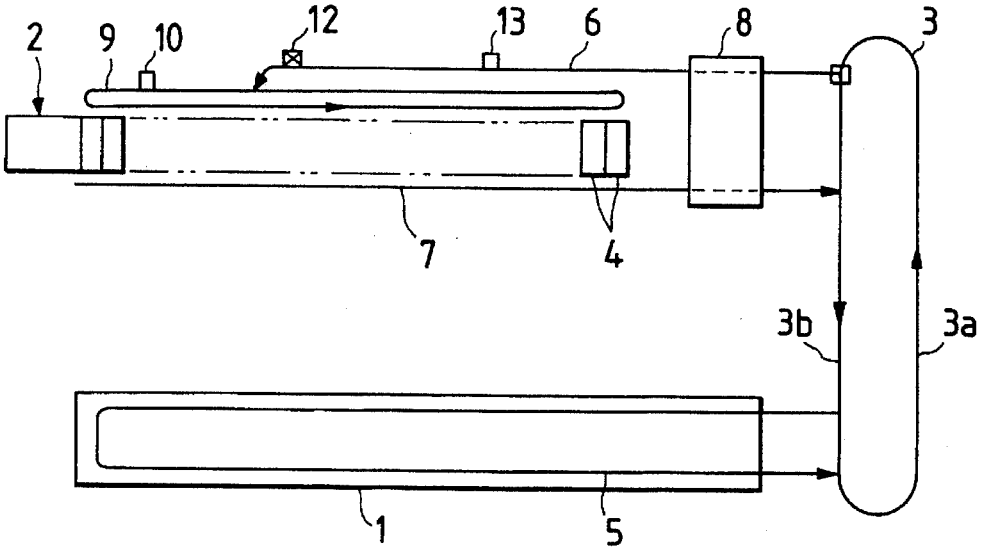
FIG. 1 is a plan view showing one embodiment of a bobbin supplying system according to the present invention.

In FIG. 1, reference numeral 1 designates spinning frames for producing bobbins, and reference numeral 2 designates winders for rewinding the bobbin onto a package, these spinning frames 1 and winders 2 being connected with each other through a common bobbin conveying passage 3. For the purpose of attaining a higher efficiency, a plurality of spinning frames 1 and winders 2 are connected (not shown). Each winder 2 is composed of a plurality of juxtaposed winding units 4 . . . and each spinning frame is also composed of a plurality of juxtaposed spinning units (not shown).

The bobbin conveying passage 3 is in the form of a closed loop so that a bobbin (a spinning bobbin) produced by the spinning frame 1 is conveyed along a forward path 3*a* of the bobbin conveying passage 3 to each winder 2, rewound by each winder 2, and a bobbin without yarn (an empty bobbin) is conveyed along a backward path 3*b* of the bobbin conveying passage 3 and returned to each spinning frame 1. The bobbin conveying passage 3 and each spinning frame 1 are connected through a transport passage 5 formed to transport along the arranging direction of the spinning units, and the bobbin conveying passage 3 and each winder 2 are connected through a spinning bobbin supplying passage 6 and an empty bobbin returning passage 7. The spinning bobbin supplying passage 6 and the empty bobbin returning passage 7 which connect the bobbin conveying passage 3 with each winder 2 are provided with a bobbin finding and supplying device (CBF) 8 for fining a yarn end of a spinning bobbin.

The spinning bobbin supplying passage 6 has a circulating passage 9 in the form of a closed loop along the arranging direction of winding units 4 on the bobbin supply side thereof, and the empty bobbin returning passage 7 is formed in the arranging direction of winding units 4 on the bobbin discharge side thereof. These bobbin conveying passage 3, transport passage 5, spinning bobbin supplying passage, circulating passage 9 and empty bobbin returning passage 7 are respectively formed from a belt conveyor for conveying a bobbin stood upright on a tray along with the tray.

The circulating passage 9 stores thereon a plurality of spinning bobbins circulated, and when an empty bobbin is discharged out of the winding unit 4, a spinning bobbin is automatically taken into the winding unit 4 from the circulating passage 9. This circulating passage 9 is provided with a bobbin sensor 10 for detecting the passing of bobbins, and at an inlet of the circulating passage 9 (an outlet of the spinning bobbin supplying passage) 11 is provided a stopper 12 for preventing the reception of bobbins in a manner such that when the number of passing bobbins per a predetermined time detected by the bobbin sensor 10 exceeds a set value, the inlet 11 is closed.

Figure 2:
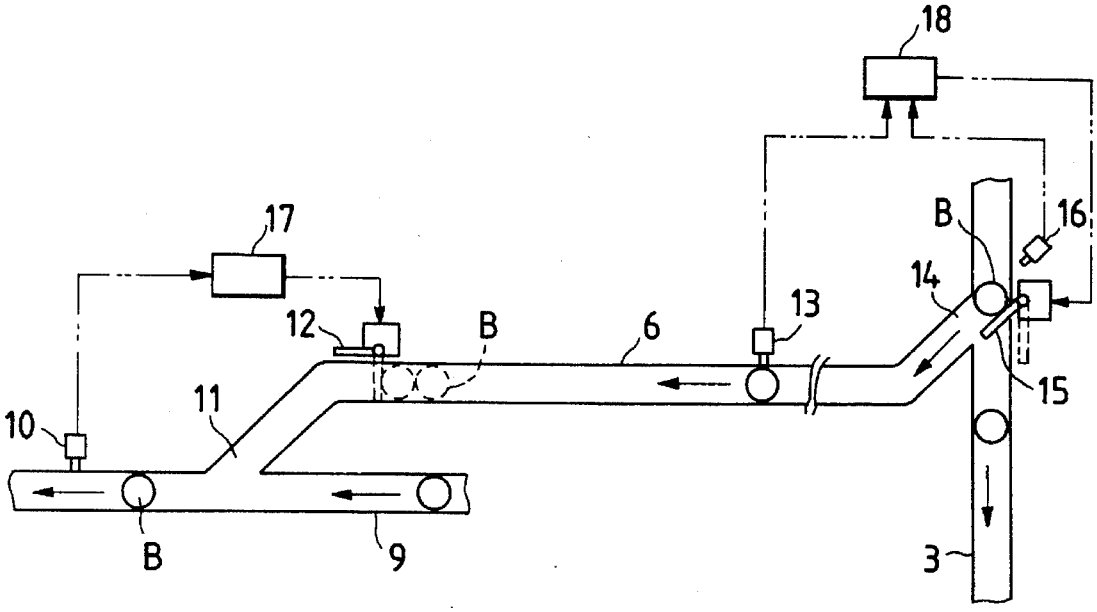
FIG. 2 is an enlarged plan view of essential parts.

The spinning bobbin supplying passage 6 is connected at a position on the circulating passage 9 sufficiently away from the bobbin conveying passage 3 to extend the distance so that when the stopper 12 is closed, bobbins can be stayed at the upstream side of the stopper 12. A full sensor 13 is provided upstream of the stopper 12 of the spinning bobbin supplying passage 6 to detect that a predetermined number of spinning bobbins are stored, and a gate 15 is provided at an inlet 14 of the spinning bobbin supplying passage 6 to stop the reception of spinning bobbins from the bobbin conveying passage 3 in accordance with a detection signal of the full sensor 13. As shown in FIG. 2, the spinning bobbin supplying passage 6 is connected obliquely with respect to the bobbin conveying passage 3 so that as shown by solid lines of FIG. 2, when the gate 15 shuts off the bobbin conveying passage 3 (the receiving position), a spinning bobbin B is taken into the spinning bobbin supplying passage 6, and as shown by the phantom line, when the gate 15 is opened (the non-receiving position), a spinning bobbin is conveyed onto the bobbin conveying passage 3 but not taken into the spinning bobbin supplying passage. A discrimination sensor 16 is provided in the vicinity of the gate 15 to discriminate whether a bobbin which circulates on the bobbin conveying passage 3 is a spinning bobbin or an empty bobbin so that when a spinning bobbin is detected, the gate 15 is set to a receiving position, and when an empty bobbin is detected, the gate 15 is set to a non-receiving position.

For the purpose of performing the above-described control, there is provided a first control station 17 wherein when the number of passing bobbins per unit time detected by the bobbin sensor 10 exceeds a set value, the stopper 12 is closed, and when it is less than a set value, the stopper 12 is opened (released). There is further provided a second control station 18 wherein when a spinning bobbin is detected by the discrimination sensor 16, the gate 15 is set to a receiving position; when an empty bobbin is detected, the gate 15 is set to a non-receiving position in preference to the detection signal from the discrimination sensor 16.

The operation of the above-described embodiment will be described hereinafter. The spinning bobbin B produced by the spinning frame 1 is conveyed in the state where it is stood upright on a tray along the forward path **3*a* of the bobbin conveying passage 3, taken into the spinning bobbin supplying passage 6 by the gate 15 and reaches the circulating passage 9. The spinning bobbins B which circulate on the circulating passage 9 are suitably taken into the winding unit 4. However, when a supply of spinning bobbins to the circulating passage 9 is in excess of such demand as just noted and the number of passing bobbins per unit time detected by the bobbin sensor 10 exceeds a set value, the stopper 12 is closed to stop the reception of spinning bobbins to the circulating passage 9. As described above, since the stopper 12 is provided at the inlet 11 of the circulating passage 9 so as to prevent the reception of the spinning bobbins B before they enter the circulating passage 9, even if the spinning bobbins B remain on the spinning bobbin supplying passage 6, they are not taken into the circulating passage 9 and the surplus reception of spinning bobbins to the circulating passage 9 can be completely prevented. Thereafter, when the number of passing bobbins per unit time is less than the set value due to the demand of spinning bobbins caused by the winding units 4, the stopper 12 is released so that spinning bobbins are sequentially taken into the circulating passage 9 from the spinning bobbin supplying passage 6**.

On the other hand, when the time during which the stopper 12 is closed extends, the number of spinning bobbins B stored (accumulated) upstream of the stopper 12 increases but spinning bobbins more than as needed are prevented from being taken into the spinning bobbin supplying passage 6 since the gate 15 provided at the inlet 14 of the spinning bobbin supplying passage 6 is set to a non-receiving position in accordance with the detection signal. Thereafter, when the spinning bobbins B on the spinning bobbin supplying passage 6 are reduced by the release of the stopper 12 and the full sensor 13 does not detect the full state of spinning bobbins, the gate 15 is controlled by the detection signal by the discrimination sensor 16 so that spinning bobbins are taken into the spinning bobbin supplying passage 6.

Namely, according to the present invention, when the number of passing bobbins per predetermined time on the circulating passage detected by the bobbin sensor exceeds a set value, the reception of bobbins is prevented by the stopper provided at the inlet of the circulating passage. With this arrangement, even if bobbins remain on the spinning bobbin supplying passage which connects the bobbin conveying passage with the circulating passage, the remaining bobbins are not taken into the circulating passage, and the surplus reception of bobbins into the circulating passage can be completely prevented. Next, a second embodiment of the present invention will be illustrated referring to FIGS. 3 to 6. This embodiment provides a bobbin supplying system which can control the reception of bobbins from a main conveying passage to a bobbin supplying passage of winders to prevent the surplus of reception of bobbins to the reserve lines.

This embodiment of the present invention provides a bobbin supplying system wherein a plurality of spinning frames and a plurality of winders are connected by a common main conveying passage, and reserve lines for circulating and storing spinning bobbins are provided on a spinning bobbin supplying passage from said main conveying passage to each winder, the system comprising a gate provided closeably at an inlet of said spinning bobbin supplying passage, bobbin sensors provided on said reserve lines to detect the passage of bobbins, and bobbin reception control means which receives a detection signal of said bobbin sensors and closes said gate when the number of passing bobbins per predetermined time exceeds a predetermined number.

The bobbin sensor detects passing of bobbins which circulate on the reserve lines. The bobbin reception control means always monitors a signal from the bobbin sensor, closes, when the number of all bobbins (stored number) on the reserve lines obtained by the number of passing bobbins per predetermined time exceeds a predetermined number, the gate of the spinning bobbin supplying passage including the reserve lines to stop the reception of bobbins to the bobbin supplying passage, and opens, when the number of all bobbins is less than a predetermined number, the gate of the spinning bobbin supplying passage to release the stop of reception.

For this reason, even if a number of bobbins are conveyed on the main conveying passage, the reception of bobbins to the spinning bobbin supplying passage including the reserve lines in which the number of stored bobbins is already in excess of a predetermined number is not executed and therefore further bobbins are not taken into the reserve lines, thus preventing an occurrence of jam.

Figure 3:
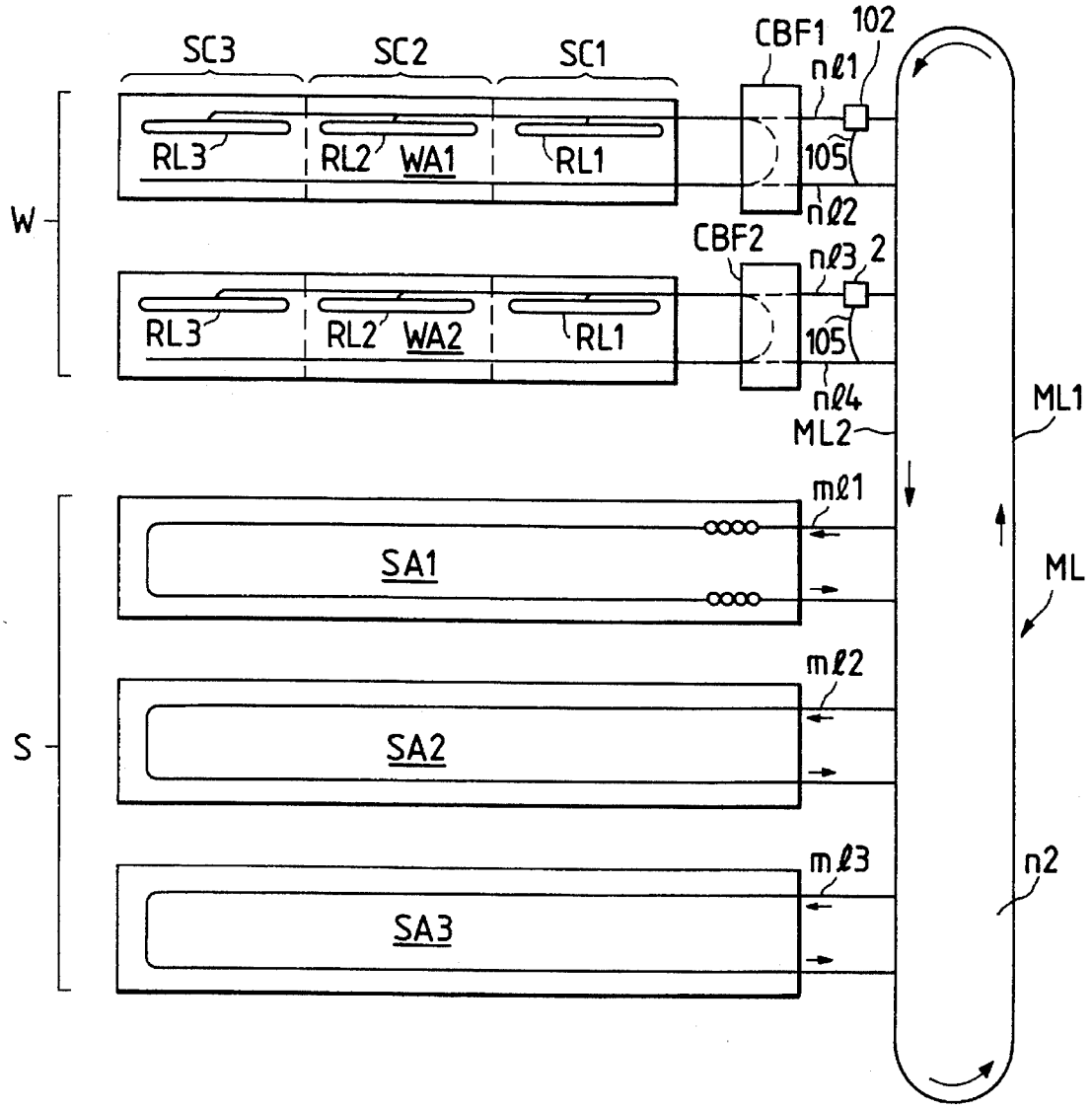
FIG. 3 is a schematic plan view showing second embodiment of a system according to the present invention.

In FIG. 3, WA1 and WA2 represent winders, and SA1, SA2 and SA3 represent spinning frames. A winder area W and a spinning frame area S are connected by a common main conveying passage ML. The winders WA1 and WA2 are substantially divided into three sections SC1, SC2 and SC3 by a plurality of winding units. In the section SC1, yarn of kind A, yarn of kind B and yarn of kind C are wound on the section SC1, section SC2 and section SC3, respectively. In the spinning frame area S, the spinning frame SA1, spinning frame SA2 and spinning frame SA3 produce yarn of kind A, yarn of kind B and yarn of kind C, respectively.

Three kinds of yarns produced by the spinning frames SA1 to SA3 are formed into spinning bobbins, which are conveyed on the conveying passage (supplying passage) ML1, and empty bobbins rewound by the winders WA1 and WA2 are conveyed on the conveying passage (returning passage) ML2 and returned to the spinning frames SA1 to SA3. The spinning frame SA1 and the main conveying passage ML are connected by an exclusive-use conveying passage ml1, and the spinning frames SA2 and SA3 and the main conveying passage ML are connected by exclusive-use conveying passages ml2 and ml3 in a similar manner.

Also on the winder side, the winder WA1 and the main conveying passage ML are connected by a spinning bobbin supplying passage nl1 and an empty bobbin returning passage nl2, and the winder WA2 and the main conveying passage ML are connected by a spinning bobbin supplying passage nl3 and an empty bobbin returning passage nl4. The spinning bobbin supplying passages nl1 and nl3 are provided with reserve lines RL1 to RL3 for circulating and storing bobbins by sections. CBF1 and CBF2 represent apparatus for continuously automatically supplying bobbins provided between the winders WA1 and WA2 and the main conveying passage ML. On the spinning bobbin supplying passage nl1 and nl3, yarn ends of spinning bobbins received from the main conveying passage ML are found and the bobbins are supplied to the winders WA1 and WA2. On the returning passages nl2 and nl4, bobbins with a small amount of remaining yarn returned are processed, bobbins which are extremely small in amount of yarn so that they cannot be re-supplied to the winders WA1 and WA2 are discharged outside the conveying passage system, and only a small amount of remaining yarn on the bobbins are removed and transferred as empty bobbins to the main conveying passage ML. On the main conveying passage ML side of these CBF1 and CBF2, bypasses 105 and 105 for connecting the spinning bobbin supplying passages nl1 and nl3 with the empty bobbin returning passages nl2 and nl4 are provided. At the branch portion between the bypasses 105 and 105 and the spinning bobbin supplying passages nl1 and nl3 is provided a bobbin reception stop device 102, which will be described later.

Figure 4:
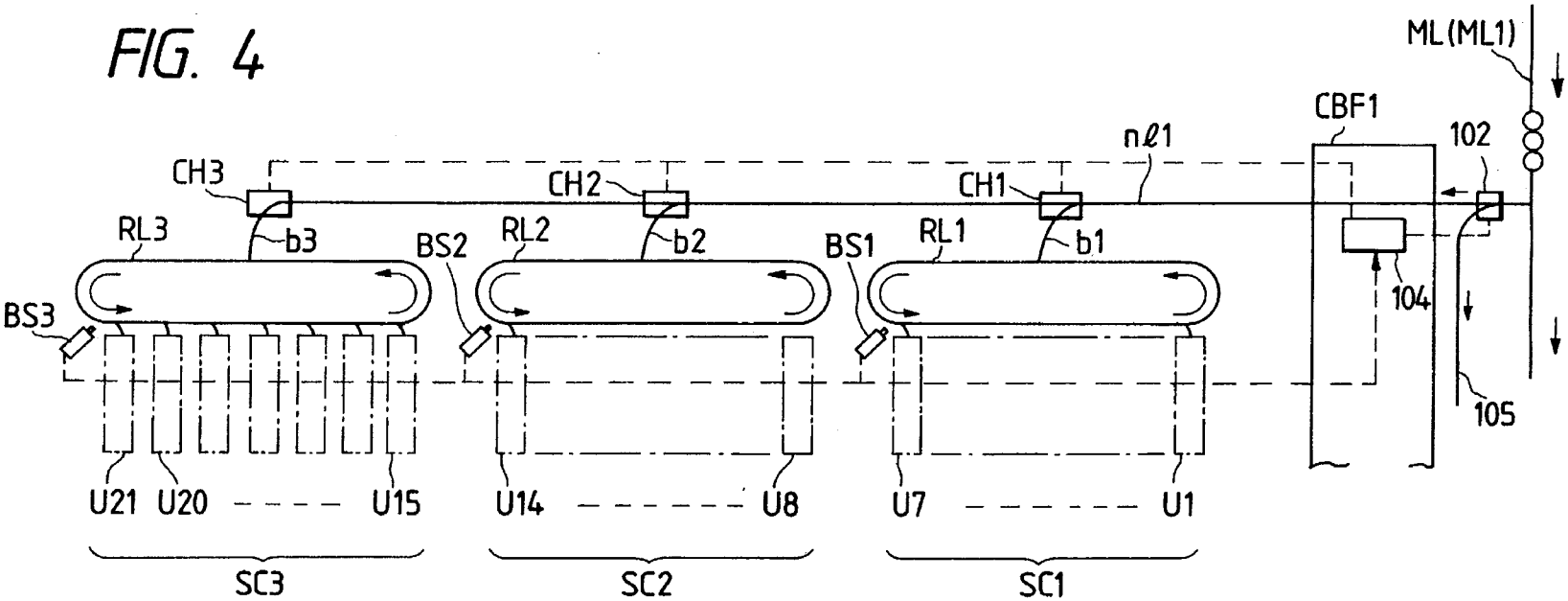
FIG. 4 is a schematic plan view showing a conveying system for supplying spinning bobbins from a main conveying passage to winders in the system shown in FIG. 3.
Figure 6:
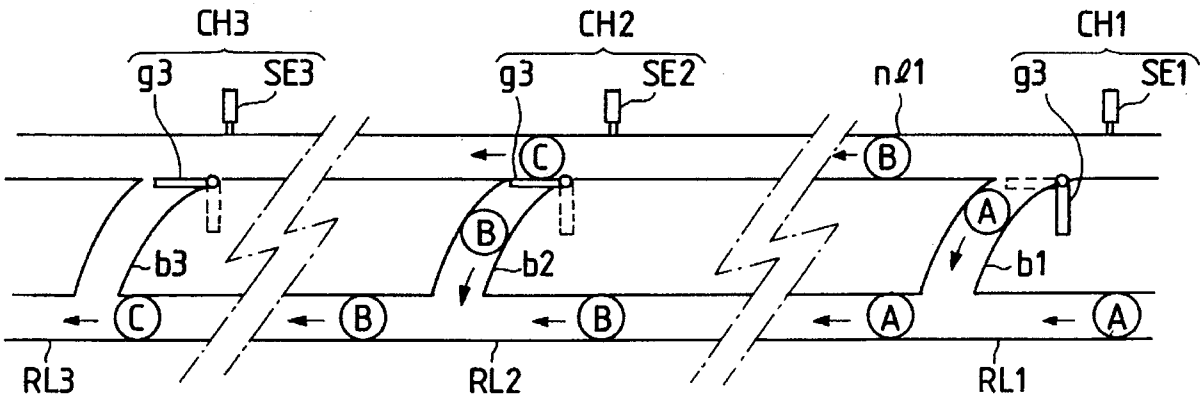
FIG. 6 is a schematic plan view of a conveying system in the winder portion of the system shown in FIG. 3.

FIG. 4 is an enlarged view of a conveying system for supplying spinning bobbins from the main conveying passage ML to the winder WA1. The conveying system for supplying spinning bobbins to the winder WA2 is similar to that on the winder WA1, and the description thereof will not be made. U1 to U2 represent winding units provided on a multi-spindle constituting the winder WA1, which are substantially divided into three sections SC1, SC2 and SC3 every seven units. Units U1 to U7 of the section SC1 are connected to the reserve line RL1 on the most upstream side of the spinning bobbin supplying passage nl1. Units U8 to U14 of the section SC2 and units U15 to U21 of the section SC3 are similarly connected to the middle reserve line RL2 and the downstream reserve line RL3, respectively. CH1 to CH3 represent bobbin select devices provided at branch passages b1 to b3 from the spinning bobbin supplying passage nl1 to the reserve lines RL1 to RL3. The bobbin select device CH1 takes only the bobbin of kind A to the reserve line RL, the bobbin select device CH2 takes only the bobbin of kind B to the reserve line RL2, and the bobbin select device CH3 takes only the bobbin of kind C to the reserve line RL3. These bobbin select devices CH1 to CH3 are provided with sensors SE1 to SE3 for discriminating kinds of bobbins and gates g1 to g3 for opening and closing inlets of the branch passages b1 to b3, as shown in FIG. 6. Signals from the sensors SE1 to SE3 are sent to a control device 104 formed from a computer encased in CBF1, and when a bobbin of kind as demanded is discriminated, the corresponding gates g1 to g3 are opened. The reserve lines RL1 to RL3 of the sections SC1 to SC3 are provided with bobbin sensors BS1 to BS3 for detecting passing of bobbins. Output signals of these bobbin sensors BS1 to BS3 are inputted to a control device 104 encased in the CBF1.

Figure 5A:
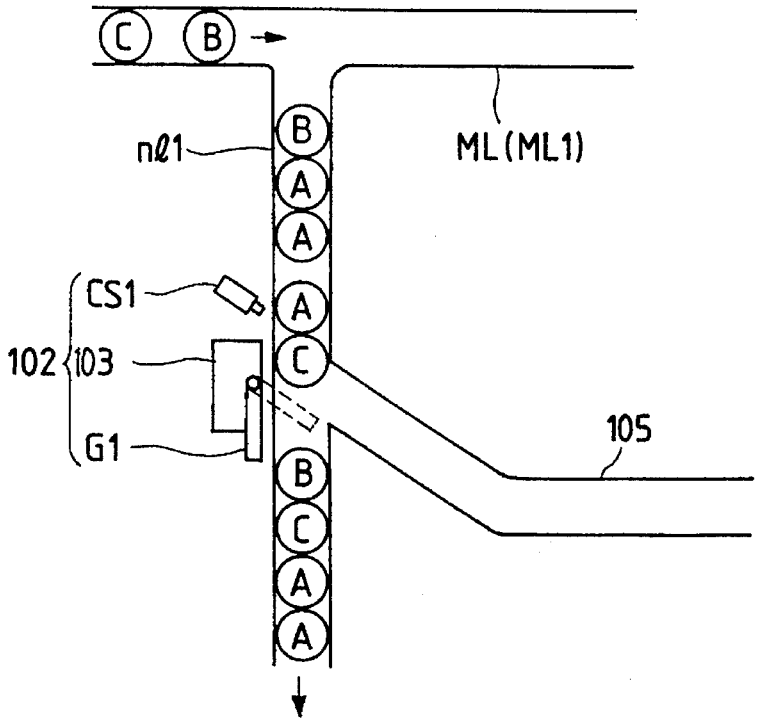
FIGS. 5*a* and 5*b* are partially enlarged plan views showing a connection portion between a main conveying passage and a bobbin supplying passage to winders in the system shown in FIG. 3.

A bobbin reception stop device 102 is provided at the branch portion between the main conveying passage ML and the spinning bobbin supplying passage nl1. As shown in FIG. 5, the bobbin reception stop device 102 is principally constituted by a color sensor CS1 provided in the vicinity of the upstream of the branch passage between the spinning bobbin supplying passage nl1 and the bypass 105 and a gate G1 provided closeably at an inlet of the bypass 105. The color sensor CS1 detects colors of bobbins and colors of marks put by kinds on trays for conveying bobbins, and output signals thereof are also inputted into the control device 104. The control device 103 for the gate G1 is driven and controlled by the control device 104 in accordance with signals from the color sensor CS1 and the bobbin sensors BS1 to BS3. Namely, the control device 104 for CBF1 drives and controls various mechanisms within the CBF1 and also has the function as bobbin reception control means. Bobbins having been conveyed onto the main conveying passage ML once enter the spinning bobbin supplying passage nl1 without fail. When the gate G1 is opened, the bobbins are taken into the downstream side of the spinning bobbin supplying passage nl1 as they are, whereas when the gate G1 is closed, the bobbins are sent to the empty bobbin returning passage nl2 passing through the bypass 105 and again returned to the main conveying passage ML.

The control device 104 always monitors signals from the bobbin sensors BS1 to BS3, and causes, when the number of passing bobbins per predetermined time (for example, the time required for the bobbin to make around the reserve line) exceeds a predetermined number (for example, 5), the gate of the spinning bobbin supplying passage including the reserve lines RL1 to RL3 to close to stop the reception of bobbins into the spinning bobbin supplying passage. In this case, the operating apparatus 1 always detects kinds conveyed to the branch portion by the color sensor CS1 of the bobbin reception stop device 102, and opens and closes the gate in accordance with the kinds of bobbins on the reserve lines on which the number of stored bobbins exceeds a predetermined number.

Figure 5B:
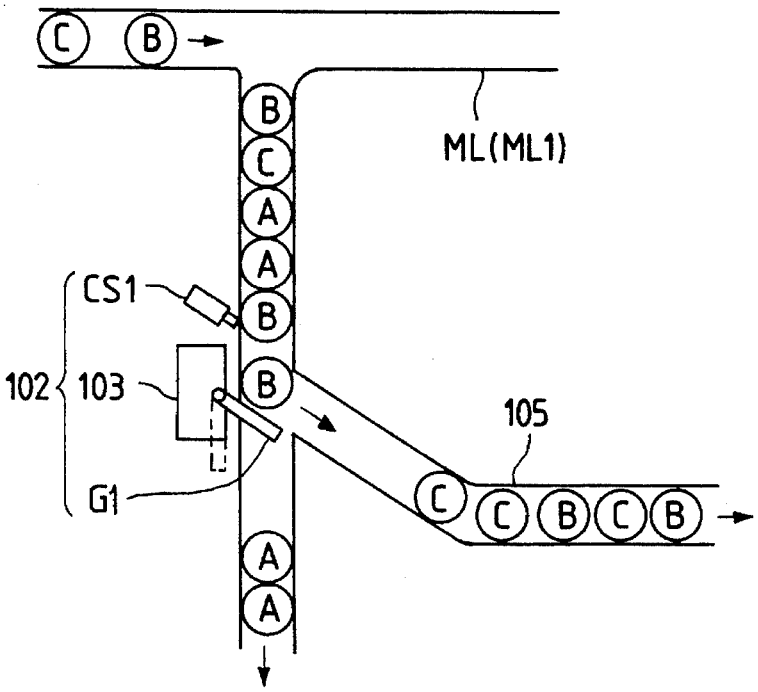

For example, when the number of all bobbins on the reserve lines RL2 and RL3 exceeds a predetermined number, the control device 104 opens the gate G1 only when the kind A is detected by the color sensor CS1, and closes the gate G1 only when other kinds B and C are detected (see FIG. 5*b*). With this, bobbins of kind A as demanded are supplied to only the reserve line RL1 enough to accept bobbins. Since a supply of bobbins to the reserve lines RL2 and RL3 in which the number of stored bobbins has already reached a predetermined number stops, and an occurrence of jam caused by the surplus reception of bobbins can be prevented.

While a description has been made of the case where many kinds of bobbins are handled, it is to be noted that in the case of handling only one kind of bobbins, the detection of kinds of bobbins by the color sensor CS1 is not necessary.

As described above, according to the present invention, extra bobbins are not taken into the reserve lines in which the number of stored bobbins has already reached a predetermined number, thus preventing an occurrence of jam.

The third embodiment of the present invention will be described hereinafter with reference to FIGS. 7 and 8.

In the conventional system, when a knotting command is issued to the winding units when a supply of bobbins to the reserve lines is short, the unit repeats piecing operation several times, and after this, the whole operation including the rotation of a drive drum stops. Thereafter, even if the short of a supply of bobbin is overcome, the operation cannot be restarted unless the operation by an operator is restored, thus posing a problem in that the working efficiency is poor.

This embodiment of the present invention has been made in consideration of the above-described circumstances. An object of this embodiment of the present invention is to provide a bobbin supplying system in which the quantity of stored bobbins on the reserve lines is monitored so that when a supply of bobbins is short, knotting of the corresponding kinds is stopped, and when a short of a supply of bobbins is overcome, the knotting stop can be automatically released.

For achieving the aforesaid object, the present invention provides a bobbin supplying system in which reserve lines for circulating or reciprocating and storing spinning bobbins are provided on a spinning bobbin supplying passage having multi-spindle winding units juxtaposed, comprising bobbin sensors provided on said reserve lines to detect the passage of bobbins, and winder control means which receives detection signals of said bobbin sensors to issue a command of knotting stop to winding units when the number of passing bobbins per predetermined time is less than a predetermined number.

The bobbin sensor detects passing of bobbins which circulate on the reserve lines. The winder control means always monitors signals from the bobbin sensors so that when the number of passing bobbins per predetermined time is less than a predetermined number, it commands a predetermined winding unit a knotting stop, and when the whole bobbin number is larger than a predetermined number, it commands a restart of knotting.

When a short of a supply of bobbins to the reserve lines occurs, the units repeat the piecing operation whereby only the knotting can be stopped before own operation is stopped. Therefore, thereafter if a short of supply of bobbins is overcome, the restart of knotting is commanded whereby the operation is restarted immediately.

An embodiment of the present invention will be described hereinafter with reference to the accompanying drawings.

Figure 7:
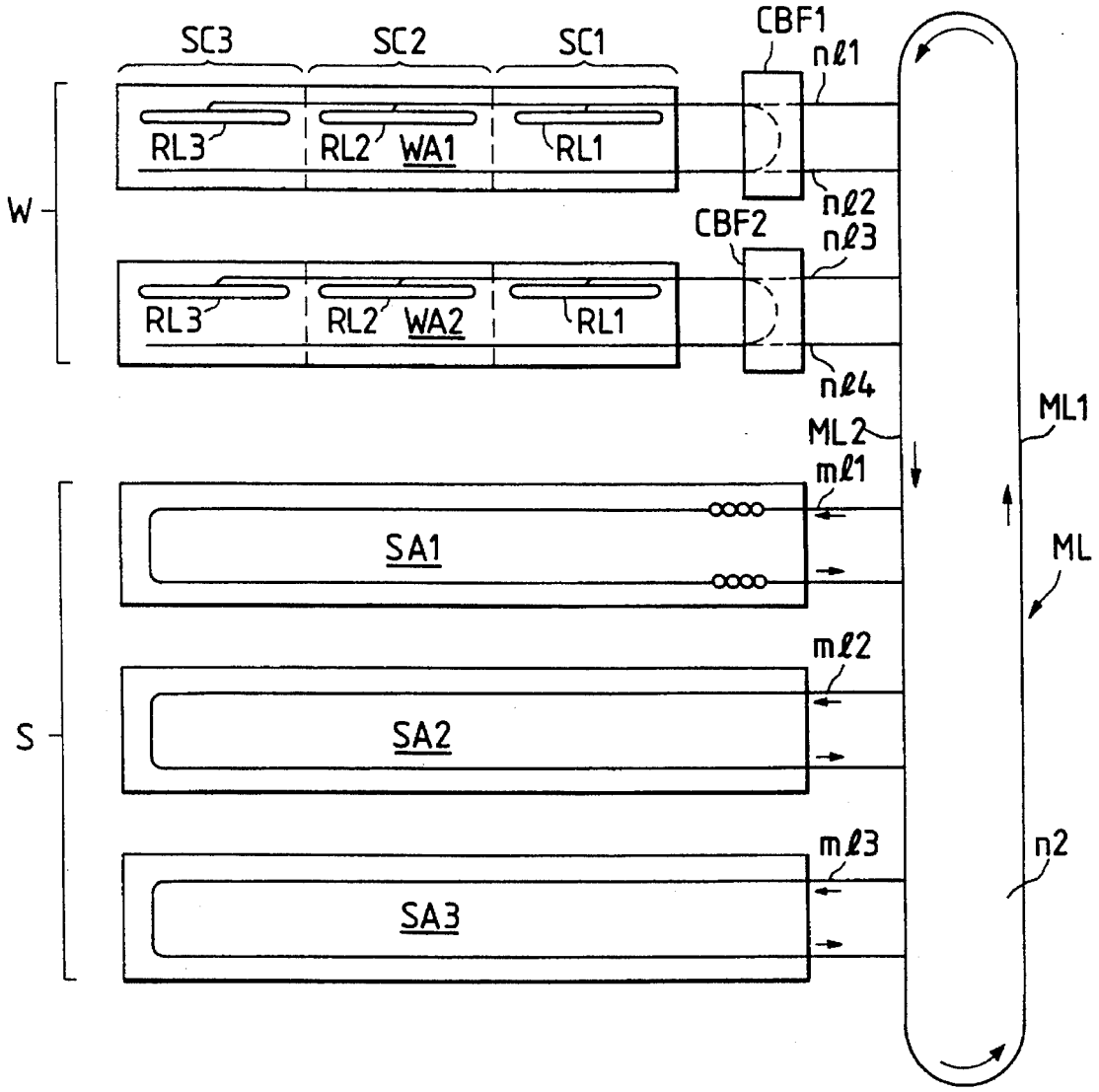
FIG. 7 is a plan view showing third embodiment of a bobbin supplying system according to the present invention.

In FIG. 7, WA1 and WA2 represent winders, and SA1, SA2 and SA3 represent spinning frames. A winder area W and a spinning frame area S are connected by a common main conveying passage ML. The winders WA1 and WA2 are substantially divided into three sections SC1, SC2 and SC3 every plural winding units so that yarn of kind A, yarn of kind B and yarn of kind C are wound in the section SC1, section SC2 and section SC3, respectively. In the spinning frame area S, the spinning frame SA1, spinning frame SB2 and spinning frame SC3 produce yarn of kind A, yarn of kind B and yarn of kind C, respectively.

Three kinds of yarns produced by the spinning frames SA1 to SA3 are formed into spinning bobbins, which are conveyed on the conveying passage (supplying passage) ML1, and empty bobbins rewound by the winders WA1 and WA2 are conveyed on the conveying passage (returning passage) ML2 and returned to the spinning frames S1 to SA3. The spinning frame SA1 and the main conveying passage ML are connected by an exclusive-use conveying passage ml1, and the spinning frames SA2 and SA3 and the main conveying passage ML are connected by exclusive-use conveying passages ml2 and ml3 in a similar manner.

Also on the winder side, the winder WA1 and the main conveying passage ML are connected by a spinning bobbin supplying passage nl1 and an empty bobbin returning passage nl2, and the winder WA2 and the main conveying passage ML are connected by a spinning bobbin supplying passage nl3 and an empty bobbin returning passage nl4. The spinning bobbin supplying passage nl1 and nl3 are provided with reserve lines RL1 to RL3 for circulating and storing bobbins by sections. CBF1 and CBF2 represent apparatus for continuously automatically supplying bobbins provided between the winders WA1 and WA2 and the main conveying passage ML. On the spinning bobbin supplying passages nl1 and nl3, yarn ends of spinning bobbins received from the main conveying passage ML are found and the spinning bobbins are supplied to the winders WA1 and WA2. On the returning passages nl2 and nl4, bobbins with a small amount of remaining yarn returned are processed, bobbins which are extremely small in amount of yarn so that they cannot be re-supplied to the winders WA1 and WA2 are discharged outside the conveying passage system, and only a small amount of remaining yarn on the bobbins are removed and transferred as empty bobbins to the main conveying passage ML.

Figure 8:
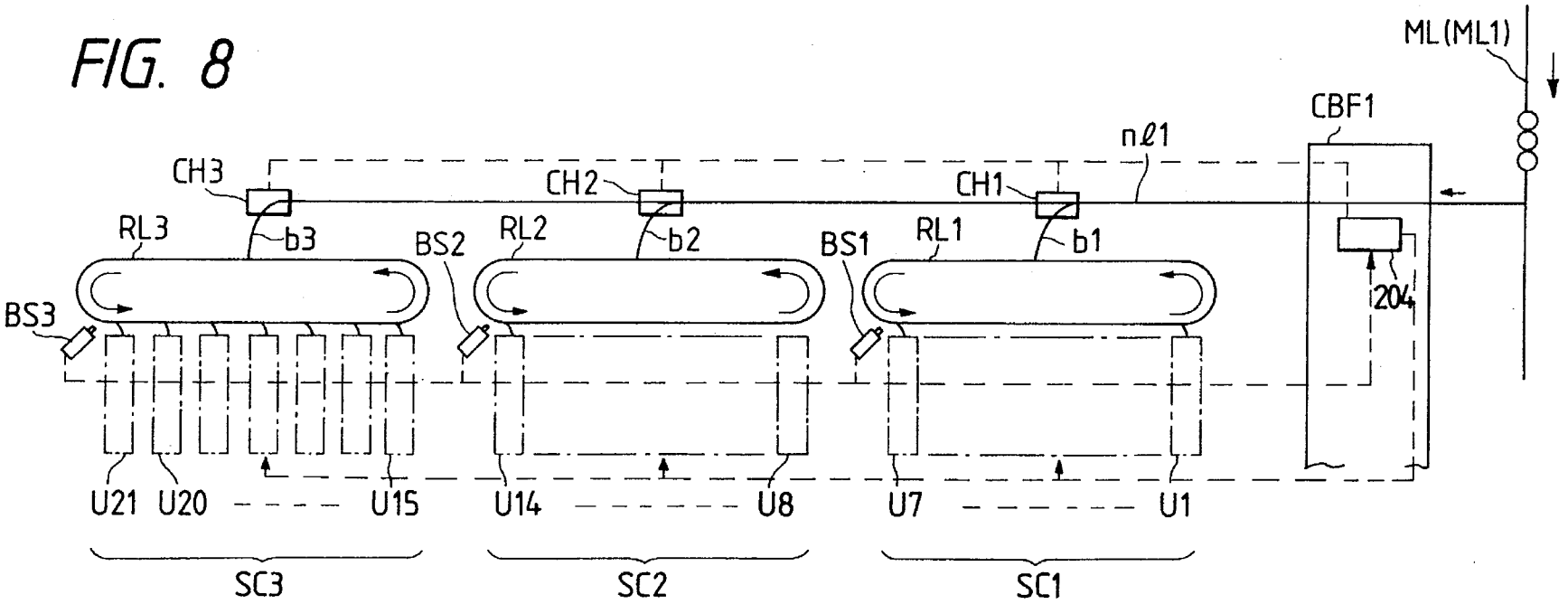
FIG. 8 is a schematic plan view showing a conveying system for supplying spinning bobbins from a main conveying passage to winders in the system shown in FIG. 7.

FIG. 8 is an enlarged view of a conveying system for supplying spinning bobbins from the main conveying passage ML to the winder WA1. The conveying system for supplying spinning bobbins to the winder WA2 is similar to that on the winder WA1, and the description thereof will not be made. U1 to U21 represent winding units provided on a multi-spindle constituting the winder WA1, which are substantially divided into three sections SC1, SC2 and SC3 every seven units. Units U1 to U7 of the section SC1 are connected to the reserve line RL1 on the most upstream side of the spinning bobbin supplying nl1. Units U8 to U14 of the section SC2 and units U15 to U21 of the section SC3 are similarly connected to the middle reserve line RL2 and the downstream reserve line RL3, respectively. CH1 to CH3 represent bobbin select devices provided at branch passages b1 to be from the spinning bobbin supplying passage nl1 to the reserve lines RL1 to RL3. The bobbin select device CH1 takes only the bobbin of kind A to the reserve line RL, the bobbin select device CH2 takes only the bobbin of kind B to the reserve line RL2, and the bobbin select device CH3 takes only the bobbin of kind C to the reserve line RL3. These bobbin select devices CH1 to CH3 are provided with sensors SE1 to SE3 for discriminating kinds of bobbins and gates g1 to g3 for opening and closing inlets of the branch passages b1 to b3, as shown in FIG. 6. Signals from the sensors SE1 to SE3 are sent to a control device 204 formed from a computer encased in CBF1, and when a bobbin of kind as demanded is discriminated, the corresponding gates g1 to g3 are opened. The reserve lines RL1 to RL3 of the sections SC1 to SC3 are provided with bobbin sensors BS1 to BS3 for detecting passing of bobbins. Output signals of these bobbin sensors BS1 to BS3 are inputted to a control device 204 encased in the CBF1.

The control device 204 always monitors signals from the bobbin sensors BS1 to BS3 so that when the number of all bobbins on the reserve lines RL1 to RL3 obtained by the number of passing bobbins per predetermined time (for example, the time required for the bobbin to make a round on the reserve line) is less than a predetermined number (for example, 3), it issues a command of knotting stop to the winding unit of the section to which the subject reserve line belongs, and when the number of all bobbins is more than a predetermined number, it issues a command of knotting restart. Namely, the control device 204 of CBF1 performs the drive and control of various mechanisms in the CBF1 and also has the function as winder control means.

For example, when the number of all bobbins in the reserve line RL1 is less than a predetermined number, the control device 204 immediately commands the winding units U1 to U7 of the section SC1 to stop knotting so that the units U1 to U7 repeat the piecing operation whereby only the knotting is stopped before own operation is stopped. Thereafter, when a short of a supply of bobbins is overcome and the number of bobbins in the reserve line RL1 increases, the control device 204 commands the units U1 to U7 to restart knotting. Thereby, the operation of the units U1 to U7 is immediately restarted.

As described above, in the system according to the present embodiment, when a supply of bobbins of specific kind is short, only the winding unit of the section which handles that kind stops its knotting, and the knotting stop is automatically released before the operator restores his operation so that the operation of the units can be restarted, thus providing an excellent operating efficiency.

It is to be noted of course that a combination of the winder control by the control device 204 and the conventional knotting-stop function (in the case where even if the units U1 to U21 repeat the piecing operation predetermined times, the piecing fails, own operation is stopped) may be employed.

Further, in detecting bobbins, a sensor for detecting a bobbin tray may be provided to detect the passage of bobbins. In this case, a proximity sensor can be used, and no erroneous operation caused by accumulation of flies or wastes occurs.

As described above, according to this embodiment of the present invention, the quantity of stored bobbins on the reserve lines are monitored so that when a supply of bobbins is short, the knotting for that kind stops, and when a short of a supply of bobbins is overcome, the knotting stop can be automatically released. Therefore, the operating efficiency is extremely good.

What is claimed is:

1. A bobbin supplying system, comprising:

at least one spinning frame, at least one winder having at least one reserve line for storing a plurality of spinning bobbins on trays and at least one winding unit for discharging empty bobbins and for automatically taking in at least one of the plurality of spinning bobbins stored on the reserve line when an empty bobbin is discharged from the winding unit, at least one conveying passage for conveying spinning bobbins from the spinning frame toward the winder, at least one supply passage for conveying spinning bobbins from the conveying passage toward the winder, the at least one reserve line being in communication with the supply passage, detecting means for detecting the plurality of spinning bobbins stored in the reserve line, and stopper means in communication with the detecting means for preventing introduction of spinning bobbins to the reserve line when the plurality of spinning bobbins stored in the reserve line exceeds a predetermined number.

2. The system of claim 1, wherein the detecting means comprises means for detecting a quantity of bobbins passing a given point in the reserve line during a given period of time, and wherein the stopper means comprises means for preventing introduction of spinning bobbins to the reserve line when the quantity of bobbins passing a given point in the reserve line during a given period of time exceeds a predetermined value.

3. The system of claim 1, comprising:

control means for controlling the stopper means to prevent introduction of spinning bobbins to the reserve line when the plurality of spinning bobbins stored in the reserve line exceeds a predetermined number and to allow introduction of spinning bobbins to the reserve line when the plurality of spinning bobbins stored in the reserve line is less than a predetermined number.

4. A bobbin supplying system, comprising:

at least one spinning frame, at least one winder having at least one reserve line for storing a plurality of spinning bobbins on trays and at least one winding unit for discharging empty bobbins and for automatically taking in at least one of the plurality of spinning bobbins stored on the reserve line when an empty bobbin is discharged from the winding unit, at least one conveying passage for conveying spinning bobbins from the spinning frame toward the winder, at least one supply passage for conveying spinning bobbins from the conveying passage toward the winder, the at least one reserve line communicating with the supply passage through an inlet, at least one closeable gate provided adjacent the inlet, at least one bobbin sensor for detecting the plurality of spinning bobbins stored in the reserve line and generating a corresponding detection signal in response thereto, and control means for receiving the detection signal from the bobbin sensor and for closing the gate to prevent introduction of spinning bobbins to the reserve line when the plurality of spinning bobbins stored in the reserve line exceeds a predetermined number.

* * * * *